US008276618B2

(12) United States Patent
Cewers

(10) Patent No.: US 8,276,618 B2
(45) Date of Patent: Oct. 2, 2012

(54) FLOW RESTRICTOR AND METHOD FOR REDUCING RESISTANCE OF A FLOW

(75) Inventor: Göran Cewers, Limhamn (SE)

(73) Assignee: Mindray Medical Sweden AB, Sundbyberg (SE)

( * ) Notice: Subject to any disclaimer, the term of this patent is extended or adjusted under 35 U.S.C. 154(b) by 0 days.

(21) Appl. No.: 13/108,769

(22) Filed: May 16, 2011

(65) Prior Publication Data

US 2011/0284086 A1 Nov. 24, 2011

Related U.S. Application Data

(60) Provisional application No. 61/345,788, filed on May 18, 2010.

(51) Int. Cl.
*F15D 1/04* (2006.01)

(52) U.S. Cl. ..... 138/37; 138/39; 137/513.3; 137/517; 137/512.15; 137/855

(58) Field of Classification Search ..... 138/46, 138/43, 37, 39; 137/513.3, 516.1, 517, 512.1, 137/856, 855, 512.15
See application file for complete search history.

(56) References Cited

U.S. PATENT DOCUMENTS

| | | | | |
|---|---|---|---|---|
| 732,068 | A * | 6/1903 | Haas | 138/46 |
| 939,549 | A * | 11/1909 | Reineking | 137/856 |
| 1,342,216 | A * | 6/1920 | Henig | 137/516.11 |
| 2,555,766 | A * | 6/1951 | Siczkiewicz, Jr. | 210/478 |
| 3,621,951 | A * | 11/1971 | Schmid | 188/282.5 |
| 4,004,609 | A * | 1/1977 | Fabry et al. | 137/512.15 |
| 4,006,634 | A | 2/1977 | Billette et al. | |
| 4,989,456 | A * | 2/1991 | Stupecky | 73/863.53 |
| 5,265,594 | A | 11/1993 | Olsson et al. | |
| 5,406,982 | A * | 4/1995 | Phillips et al. | 138/26 |
| 7,866,345 | B2 * | 1/2011 | Lowery | 138/42 |
| 2007/0283962 | A1 | 12/2007 | Doshi et al. | |

FOREIGN PATENT DOCUMENTS

SE 529989 C2 1/2008

* cited by examiner

*Primary Examiner* — Patrick F Brinson

(74) *Attorney, Agent, or Firm* — Kory D. Christensen; Stoel Rives LLP

(57) ABSTRACT

Methods and devices are described for reducing flow resistance in a flow restrictor during high flows.

25 Claims, 3 Drawing Sheets

FLOW RESTRICTOR AND METHOD FOR REDUCING RESISTANCE OF A FLOW

CROSS-REFERENCE TO RELATED APPLICATION(S)

This application claims the benefit of U.S. Provisional Application No. 61/345,788, filed May 18, 2010, which is incorporated herein by reference.

TECHNICAL FIELD

The following disclosure relates to flow restrictors.

SUMMARY OF THE DISCLOSURE

A variable flow restrictor and a method for variably altering flow resistance in a flow restrictor is disclosed.

DETAILED DESCRIPTION

Figure 1:
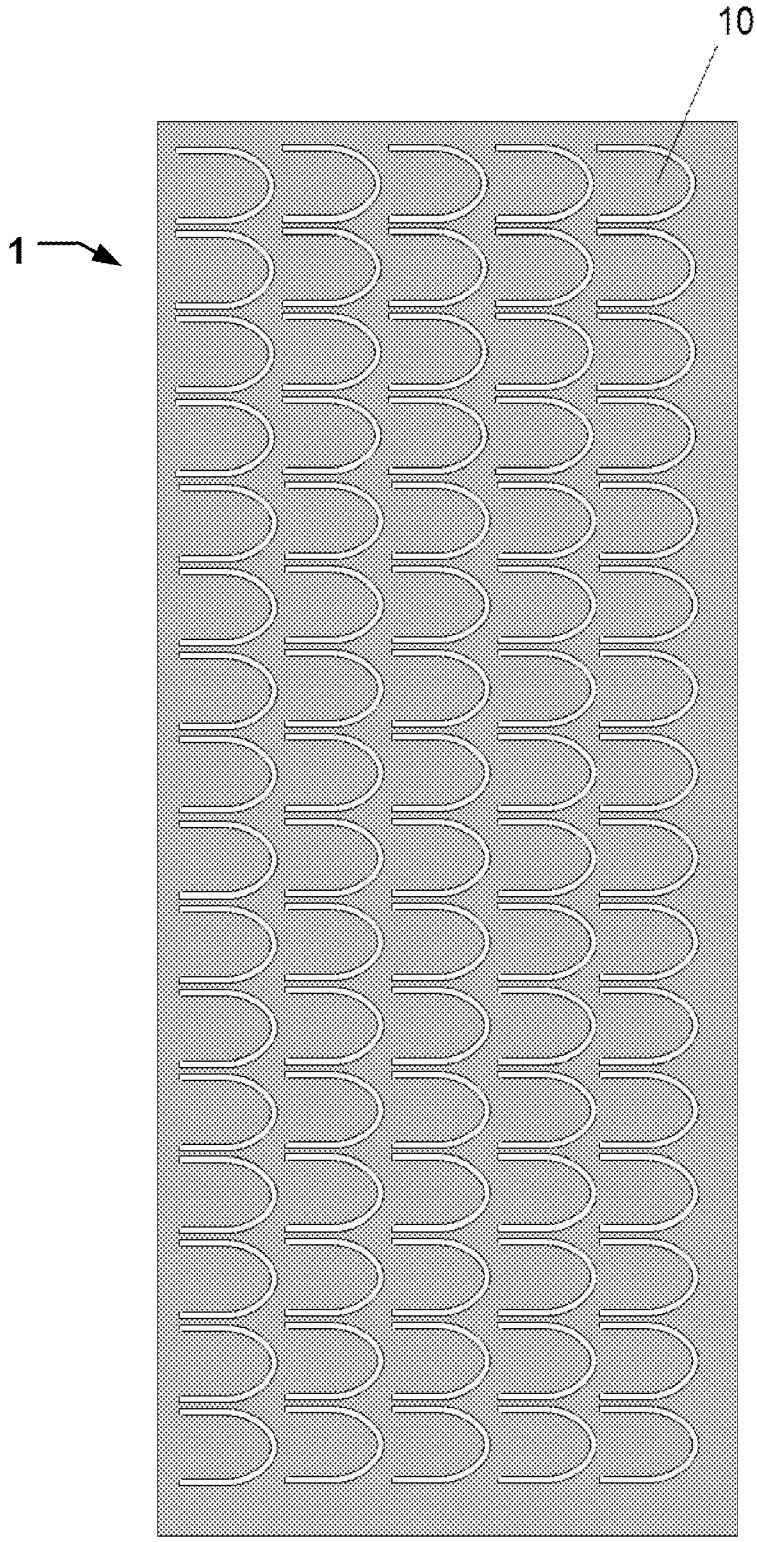
FIG. 1 shows in a schematic view an exemplary embodiment using a foil with cut out flap structures.

Various methods for measuring a flow by means of a flow restrictor are known for liquids and gases, e.g., in flow regulators for ventilators. Examples of ventilator applications are disclosed in U.S. Pat. No. 5,265,594 and Swedish Patent No. 529,989. U.S. Pat. No. 5,265,594 discloses how a flow restrictor is used for measuring gas flow through a gas channel upstream of a control valve. Swedish Patent No. 529,989 discloses how a flow restrictor is used for measuring gas flow through a gas channel downstream of a control valve.

Flow restrictors can be provided in a variety of ways, e.g., by fluid being led through one or more narrow tubes, various types of nets, sintered fluid permeable tubes or slits, or the like. In U.S. Pat. No. 4,006,634, a flow meter is disclosed, including a differential pressure gauge and a variable flow restrictor, which diminishes as flow increases. In this disclosure, the flow restrictor comprises a film with radial slits forming a number of circular shaped flaps. At high flows, the flaps bend, and the flow resistance decreases. Since it is difficult to cut extremely thin slits in a film, the flow resistance is relatively small in this design, and thus, it is difficult to measure low flows.

A method and device according to the present disclosure may provide a larger initial flow resistance than is present in a design which uses flaps bending under large flows, as described in U.S. Pat. No. 4,006,634. The method and device according to the present disclosure may provide flow restriction with reduced flow resistance in large flows. This helps in removing increased flow resistance caused by turbulence and in increasing the dynamic flow range.

According to one aspect of the disclosure, a variable flow restrictor is provided. The variable flow restrictor may include a flexible foil with movable parts, such as flaps, and a fluid permeable body. The flexible foil may be arranged immediately next to the fluid permeable body, where the movable parts are pre-tensioned against the fluid permeable body, resulting in a variable fluid flow through the flow restrictor by increased displacement of the flexible parts with increased flow through the fluid permeable body and the flexible foil.

In order to reduce the flow resistance during increased flows, a thin flexible foil with flaps may be placed close to the fluid permeable body. Due to the flaps being in tension, the flow resistance is high in small flows, which is then reduced when the flow increases. The flexible foil may be placed adjoining the fluid permeable body by bending it and placing it with its convex side against the fluid permeable body. The flexible foil may be shaped as, e.g., a cone, partial cone, or as a cylinder. The tube geometry of the entire design may have a cross-section that may be circular and/or ellipsoidal or and/or polygonal.

In some embodiments, a foil with flaps downstream is placed next to a fixed flow restrictor in the form of a net or some other fluid permeable material.

One embodiment places the above-mentioned flaps pre-tensioned against the fixed flow restrictor. This method ensures that the flow resistance is maximized at low flows. One way of pre-tensioning the flaps is to bend the foil with flaps and allow the convex side to lie against the flow restrictor, which has a matching shape. The flaps will, in this case, lie pre-tensioned against the flow restrictor. The curvature of the foil may be arbitrary in shape, such as a cone, sphere, or cylinder.

In some embodiments, the flow restrictor is provided with holes or thin material where it is covered by the above-mentioned flaps. Also, in some embodiments of the variable flow restrictor, the fluid permeable body has openings which may allow the fluid to flow under the flaps. Adding these openings or holes, which may also be thinner parts in the material, increases the effect of the variable flow restrictor by reducing the flow resistance more during flows.

In some embodiments of the variable flow restrictor, a differential pressure gauge is connected upstream of the fluid permeable body and downstream of the flexible foil.

Another aspect of the disclosure includes a method for reducing the flow resistance in a flow restrictor at an elevated flow rate. The method comprises pre-tensioning moveable parts, such as flexible flaps, on a flexible foil by placing the flexible foil next to a fluid permeable body, thus creating a variable flow restrictor in that the moveable parts are moved more and more as the flow increases, thus providing a variable fluid flow through the flow restrictor.

As used herein, the term flow resistance refers to actual flow resistance, as distinct from pressure drop.

FIG. 1 shows a schematic view of foil 1 with cut out flap structures 10. The foil may be attached to a flow restrictor, which is described below.

A flow restrictor has a defined permeability for both fluids and gases. For example, a fixed flow restrictor may be provided in the form of a net, sintered metal or ceramics of a particular pore size or cell size, or some other fluid permeable material. For example, flow restrictors are used in flow meters to create pressure drops with a desired profile. Differential pressure across a flow restrictor may be measured and provides a measure of the flow.

Figure 2:
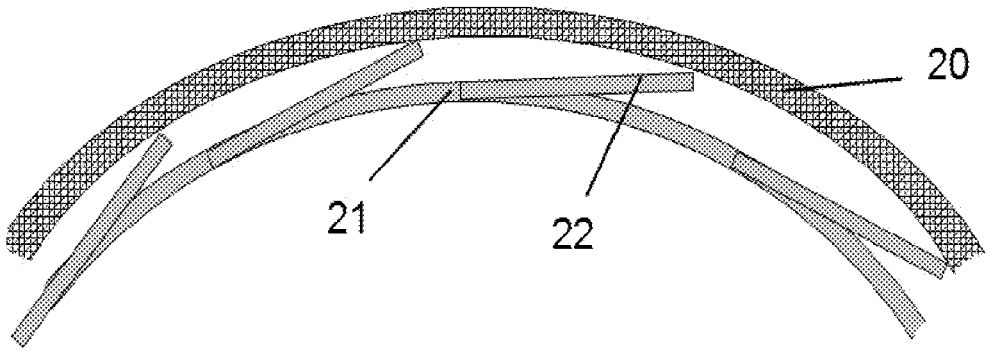
FIGS. 2-4 show in schematic views exemplary embodiments with a bent foil and a flow restrictor.

FIG. 2 shows a schematic view of an exemplary embodiment illustrating part of a bent foil 21 and a part of a flow restrictor 20 with a shape matching the contour of the foil 21. In this case, the flow restrictor and the foil are cylindrical in shape. Here, it is shown how the radially bent out flaps 22 look before the flow restrictor 20 is assembled together with foil 21.

Figure 3:
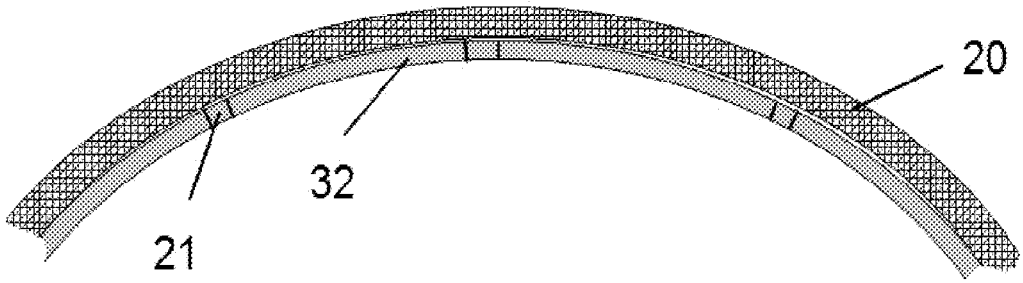

FIG. 3 shows the bent foil 21 and flow restrictor 20 with a shape matching the contour of foil 21 assembled. Here, the flaps 32 are shown in contact to flow restrictor 20 in the tensioned condition.

Figure 4:
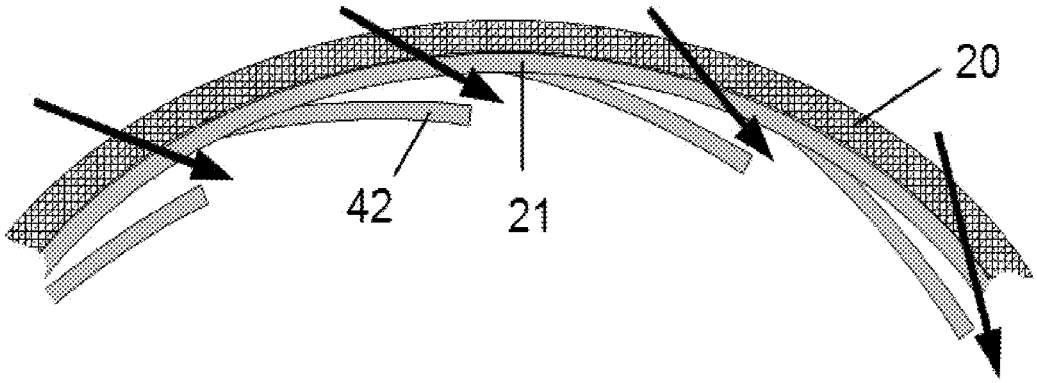

FIG. 4 shows the bent foil 21 and flow restrictor 20 with a shape matching the contour of foil 21 when a flow illustrated by the arrows in FIG. 4 passes through flow restrictor 20 and foil 21 installed downstream. Here it is shown how the now radially inwardly bent flaps 42 are bent by a larger flow, as shown by the arrows.

Figure 5:
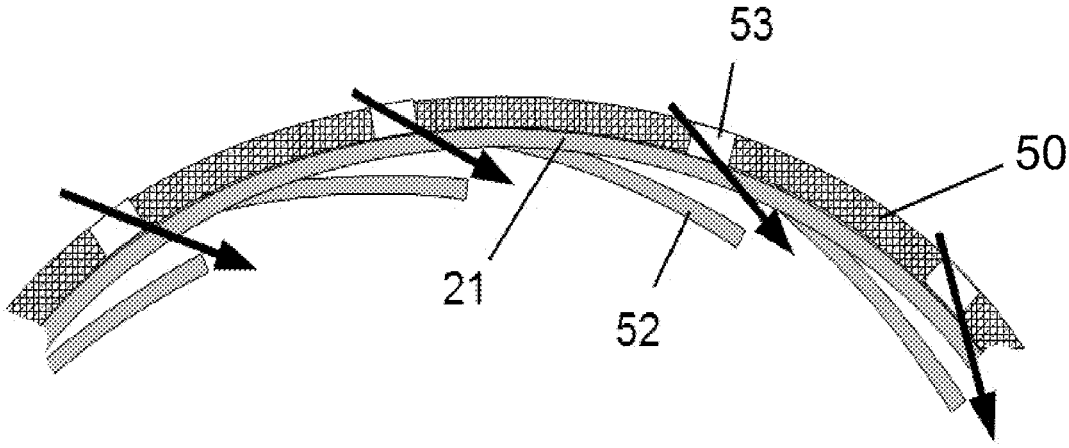
FIG. 5 shows in a schematic view an exemplary embodiment where the flow restrictor is provided with holes in the area below the flaps.

FIG. 5 shows a schematic view of an exemplary embodiment where a flow restrictor 50 is provided with holes 53 in the area below flaps 52. Here, the flaps 52 are shown being bent by a major flow, passing the holes in the flow restrictor 50, as shown by the arrows.

An example of a device in FIG. 5 according to the disclosure may be obtained by a fluid flow, as illustrated by arrows streaming through a flow restrictor 50 and further downstream through foil 21, whose flaps 52, which are an integrated part of flow restrictor 50, in major flows are bent downstream and thus open up the area of flow restrictor 50 with the consequent reduction in flow resistance.

As an alternative to, or in combination with, holes 53, the flow restrictor may be constructed of thinned down material or large pore sizes or cell sizes or filter density where it is covered by the above-mentioned flaps.

Without further elaboration, it is believed that one skilled in the art can use the preceding description to utilize the present disclosure to its fullest extent. The examples and embodiments disclosed herein are to be construed as merely illustrative, and not a limitation of the scope of the present disclosure in any way. It will be apparent to those having skill in the art that changes may be made to the details of the above-described embodiments without departing from the underlying principles of the disclosure described herein. In other words, various modifications and improvements of the embodiments specifically disclosed in the description above are within the scope of the appended claims. The scope of the invention is, therefore, defined by the following claims. The words "including" and "having," as used herein, including the claims, shall have the same meaning as the word "comprising."

What is claimed is:

1. A variable flow restrictor comprising:

a flexible foil with movable parts; and a fluid permeable body, wherein the fluid permeable body comprises thinner parts in a material used to create the fluid permeable body, or larger pore size, or cell size, or filter density, adjacent the movable parts;

wherein the flexible foil is arranged adjoining the fluid permeable body, and wherein the movable parts are tensioned against the fluid permeable body resulting in a variable fluid flow through the flow restrictor by increased displacement of the moveable parts with increased flow through the fluid permeable body and the flexible foil.

2. The flow restrictor of claim 1, wherein the movable parts of the flexible foil comprise flaps.

3. The flow restrictor of claim 1, wherein the foil is positioned downstream the fluid permeable body.

4. The flow restrictor of claim 1, wherein the flexible foil is bent and has a convex side, and wherein the flexible foil is, with its convex side, positioned against the fluid permeable body.

5. The flow restrictor of claim 1, wherein the flexible foil is cone shaped.

6. The flow restrictor of claim 1, wherein the flexible foil is shaped as a partial cone.

7. The flow restrictor of claim 1, wherein the flexible foil is shaped as a cylinder.

8. The flow restrictor of claim 1, wherein the fluid permeable body comprises openings adjacent to said movable parts which allow fluid to flow therethrough.

9. The flow restrictor of claim 1, wherein a tube geometry of the flow restrictor has a cross-section shaped as one or more of a circle, a polygon, or an ellipse.

10. The flow restrictor of claim 1, wherein a differential pressure gauge is connected upstream of the fluid permeable body and downstream of the flexible foil.

11. A method for reducing a flow resistance in a flow restrictor at an elevated flow rate, said method comprising tensioning moveable parts of a flexible foil by placing the flexible foil next to a fluid permeable body, wherein the fluid permeable body comprises thinner parts in a material used to create the fluid permeable body, or larger pore size, or cell size, or filter density, adjacent the movable parts, thereby creating a variable flow restrictor, wherein the moveable parts are increasingly displaced as the flow increases, providing a variable fluid flow through the flow restrictor.

12. The method of claim 11, wherein the movable parts comprise flaps.

13. A variable flow restrictor comprising:

a flexible foil with movable parts; and a fluid permeable body;

wherein the flexible foil is arranged adjoining the fluid permeable body, and wherein the movable parts are tensioned against the fluid permeable body resulting in a variable fluid flow through the flow restrictor by increased displacement of the moveable parts with increased flow through the fluid permeable body and the flexible foil; and wherein a differential pressure gauge is connected upstream of the fluid permeable body and downstream of the flexible foil.

14. The flow restrictor of claim 13, wherein the movable parts of the flexible foil comprise flaps.

15. The flow restrictor of claim 13, wherein the foil is positioned downstream the fluid permeable body.

16. The flow restrictor of claim 13, wherein the flexible foil is bent and has a convex side, and wherein the flexible foil is, with its convex side, positioned against the fluid permeable body.

17. The flow restrictor of claim 13, wherein the flexible foil is cone shaped.

18. The flow restrictor of claim 13, wherein the flexible foil is shaped as a partial cone.

19. The flow restrictor of claim 13, wherein the flexible foil is shaped as a cylinder.

20. The flow restrictor of claim 13, wherein the fluid permeable body comprises openings adjacent to said movable parts which allow fluid to flow therethrough.

21. The flow restrictor of claim 13, wherein the fluid permeable body comprises thinner parts in a material used to create the fluid permeable body, or larger pore size, or cell size, or filter density, adjacent the movable parts.

22. The flow restrictor of claim 13, wherein a tube geometry of the flow restrictor has a cross-section shaped as one or more of a circle, a polygon, or an ellipse.

23. The flow restrictor of claim 13, wherein a differential pressure gauge is connected upstream of the fluid permeable body and downstream of the flexible foil.

24. A method for reducing a flow resistance in a flow restrictor at an elevated flow rate, said method comprising tensioning moveable parts of a flexible foil by placing the flexible foil next to a fluid permeable body, thereby creating a variable flow restrictor, wherein the moveable parts are increasingly displaced as the flow increases, providing a variable fluid flow through the flow restrictor; and wherein a differential pressure gauge is connected upstream of the fluid permeable body and downstream of the flexible foil.

25. The method of claim 24, wherein the movable parts comprise flaps.

* * * * *